US008207927B2

(12) United States Patent
Park et al.

(10) Patent No.: US 8,207,927 B2
(45) Date of Patent: Jun. 26, 2012

(54) LIQUID CRYSTAL DISPLAY AND METHOD OF OPERATING THE SAME

(75) Inventors: Sang-Heon Park, Asan-si (KR); Ji-Man Myeong, Suwon-si (KR); Jae-Hyun Kim, Asan-si (KR); Won-Kyung Moon, Cheonan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 703 days.

(21) Appl. No.: 12/360,352

(22) Filed: Jan. 27, 2009

(65) Prior Publication Data

US 2010/0045583 A1 Feb. 25, 2010

(30) Foreign Application Priority Data

Aug. 20, 2008 (KR) ..... 2008-0081464

(51) Int. Cl.
*G09G 3/36* (2006.01)

(52) U.S. Cl. ..... 345/89

(58) Field of Classification Search ..... 345/87, 345/89, 92, 93
See application file for complete search history.

(56) References Cited

U.S. PATENT DOCUMENTS 7,379,004 B2 * 5/2008 Hsu et al. ..... 341/144
2008/0062100 A1 * 3/2008 Hong et al. ..... 345/87
* cited by examiner

*Primary Examiner* — Adam R Giesy
(74) *Attorney, Agent, or Firm* — F. Chau & Associates, LLC

(57) ABSTRACT

A liquid crystal display and a method of operating the liquid crystal display, in which the liquid crystal display includes a liquid crystal panel, a gate driver, a gamma voltage generator, a data driver, and a gamma voltage compensator. The liquid crystal panel has a plurality of pixels respectively arranged in pixel areas defined by gate lines and data lines. The gate driver drives the gate lines, and the gamma voltage generator generates gamma voltages having different voltage levels from each other. The data driver drives the data lines according to the gamma voltages. The gamma voltage compensator compensates for at least one of the gamma voltages, which are generated from the gamma voltage generator, by using one of a gate-off voltage provided to the gate lines and a storage voltage provided to a storage capacitor included in the pixel.

14 Claims, 10 Drawing Sheets

LIQUID CRYSTAL DISPLAY AND METHOD OF OPERATING THE SAME

CROSS-REFERENCE TO RELATED APPLICATION

This application relies for priority upon Korean Patent Application No. 2008-81464 filed on Aug. 20, 2008, the contents of which are herein incorporated by reference in their entirety.

BACKGROUND

1. Technical Field

The present disclosure relates to a display apparatus. More particularly, the present disclosure relates to a liquid crystal display and a method of operating the liquid crystal display.

2. Discussion of Related Art

A liquid crystal display includes two substrates and liquid crystals having dielectric anisotropy are injected between the two substrates. An electric field is applied to the liquid crystals and the intensity of the electric field is adjusted to control the amount of light passing through the substrates. As a result, desired images are displayed on the liquid crystal display.

Each pixel of the liquid crystal display includes a red sub-pixel, a green sub-pixel and a blue sub-pixel that serve to adjust light transmittance as the alignment of the liquid crystals varies according to a data signal. Each sub-pixel is charged with a differential voltage between a data voltage provided to a pixel electrode through a thin film transistor and a common voltage provided to a common electrode, thereby driving the liquid crystals. The thin film transistor is turned on by a gate-on voltage provided through a gate line, so that a pixel electrode is charged with a data signal provided through a data line. The thin film transistor is turned off by a gate-off voltage provided through the gate line, so that the data signal charged in the pixel electrode is maintained.

Because such a liquid crystal display has a low power consumption and is fabricated in a thin plate structure, the liquid crystal display is extensively employed in portable electronic appliances, such as cellular phones, electronic calculators and portable computer systems, as well as in a control panel of various machines. Accordingly, various studies have been continuously performed to improve the display quality of the liquid crystal display.

SUMMARY

An exemplary embodiment of the present invention provides a liquid crystal display capable of improving a display quality by removing a crosstalk phenomenon or a greenish phenomenon.

Another exemplary embodiment of the present invention provides a method of operating the liquid crystal display.

In an exemplary embodiment of the present invention, a liquid crystal display includes a liquid crystal panel, a gate driver, a gamma voltage generator, a data driver, and a gamma voltage compensator. The liquid crystal panel has a plurality of pixels respectively arranged in pixel areas defined by gate lines and data lines crossing the gate lines. The gate driver drives the gate lines. The gamma voltage generator generates gamma voltages having voltage levels that are different from each other. The data driver drives the data lines according to the gamma voltages. The gamma voltage compensator compensates for at least one of the gamma voltages, which are generated by the gamma voltage generator, by using one of a gate-off voltage provided to the gate lines and a storage voltage provided to a storage capacitor included in the pixel.

The gamma voltage compensator includes at least one capacitor that capacitively couples one of the gate-off voltage and the storage voltage with the at least one gamma voltage.

In an exemplary embodiment of the present invention, a method of operating a liquid crystal display is provided as follows. When gamma voltages having different voltage levels are generated, at least one of the gamma voltages is compensated by using one of a gate-off voltage provided to gate lines and a storage voltage provided to a storage capacitor included in a pixel. A data voltage is applied to a liquid crystal panel according to the at least one gamma voltage compensated based on the gate-off voltage and the storage voltage.

The at least one gamma voltage is compensated by capacitively coupling one of the gate-off voltage and the storage voltage with the at least one gamma voltage.

According to the above, a crosstalk phenomenon and a greenish phenomenon can be prevented, so that an image display quality of the liquid crystal display can be improved.

BRIEF DESCRIPTION OF THE DRAWINGS

Exemplary embodiments of the present invention will be understood in more detail from the following descriptions taken in conjunction with the accompanying drawings, wherein.

DETAILED DESCRIPTION OF EXEMPLARY EMBODIMENTS

Hereinafter, exemplary embodiments of the prevent invention will be described in detail with reference to the accompanying drawings.

Figure 1:
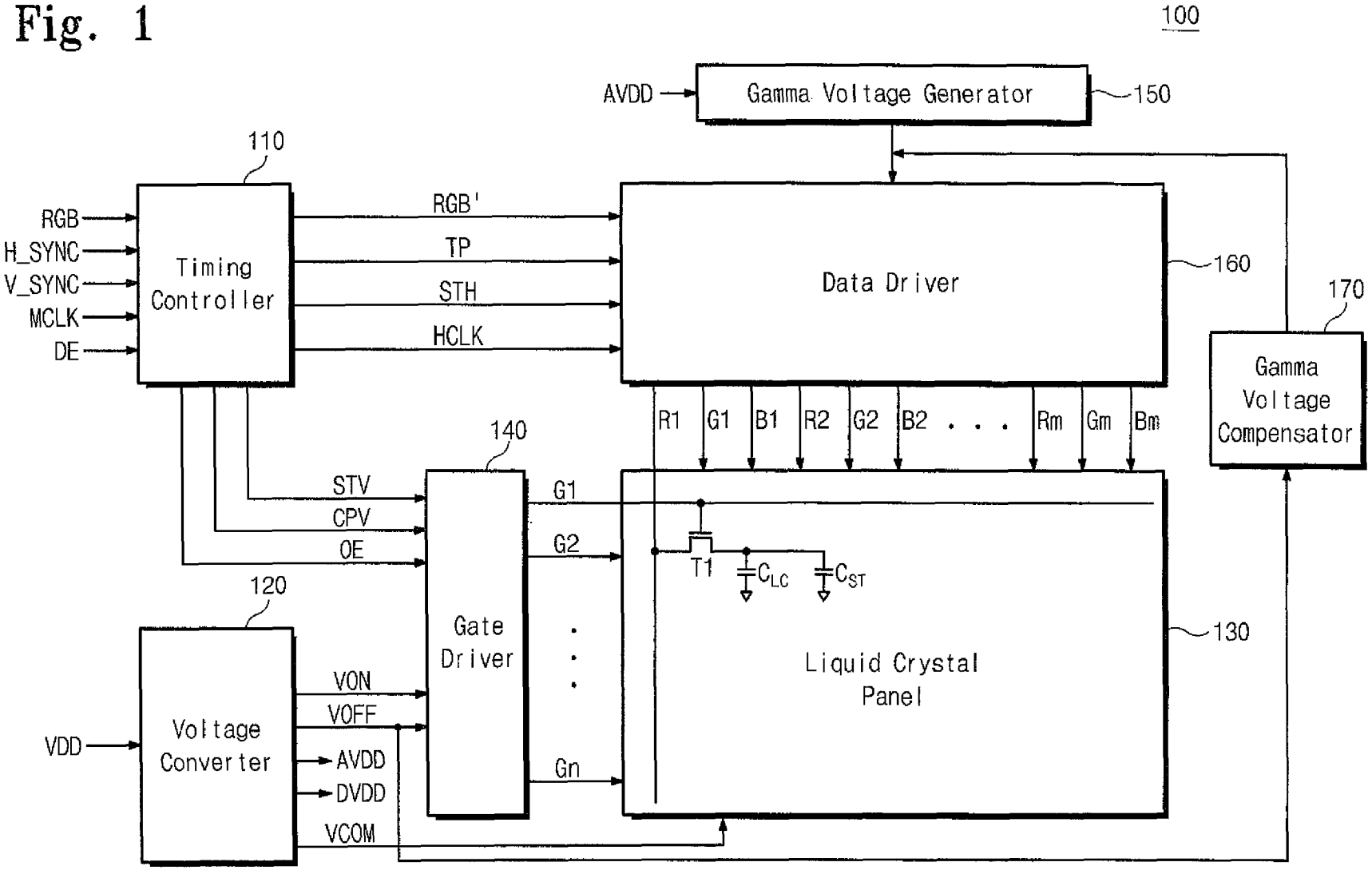
FIG. 1 is a block diagram showing an exemplary embodiment of a liquid crystal display according to the present invention.

FIG. 1 is a block diagram showing an exemplary embodiment of a liquid crystal display according to the present invention.

Referring to FIG. 1, a liquid crystal display 100 includes a timing controller 110, a voltage converter 120, a liquid crystal panel 130, a gate driver 140, a gamma voltage generator 150, a data driver 160 and a gamma voltage compensator 170.

The timing controller 110 receives a pixel data signal RGB, a horizontal synchronization signal H_SYNC, a vertical synchronization signal V_SYNC, a clock signal MCLK and a data enable signal DE from an external device (not shown). The timing controller 110 outputs a pixel data signal RGB', which has a data format converted corresponding to a required interface between the timing controller 110 and the data driver 160, and various control signals to the data driver 160. The control signals output from the timing controller 110 to the data driver 160 include a latch signal TP, a horizontal synchronization start signal STH, and a clock signal HCLK. In addition, the timing controller 110 outputs a vertical synchronization start signal STV, a gate clock signal CPV and an output enable signal OE to the gate driver 140.

The voltage converter 120 receives a DC power VDD from an outside source (not shown) to generate a plurality of voltages used to operate the liquid crystal display 100. The voltages used to operate the liquid crystal display 100 include an analog supply voltage AVDD, a digital supply voltage DVDD, a gate-on voltage VON, a gate-off voltage VOFF, and a common voltage VCOM. The gate-on voltage VON and the gate-off voltage VOFF are provided to the gate driver 140, and the analog supply voltage AVDD and the digital supply voltage DVDD are used as drive voltages of the liquid crystal display 100. The common voltage VCOM is provided to a common electrode (not shown) of the liquid crystal panel 130. Preferably, the voltage converter 120 includes a DC/DC converter (not shown).

The liquid crystal panel 130 includes a plurality of gate lines G1~Gn, a plurality of data lines R1~Rm, G1~Gm and B1~Bm crossing the gate lines G1~Gn, and pixels respectively arranged in pixel areas defined by the gate lines G1~Gn and the data lines R~Rm, G1~Gm and B1~Bm. Each pixel includes a thin film transistor T1 having a gate electrode connected to a corresponding gate line G1 of the gate lines G1~Gn and a source electrode connected to a corresponding data line R1 of the data lines R1~Rm, G1·Gm, and B1~Bm, and a liquid crystal capacitor $C_{LC}$ and a storage capacitor $C_{ST}$ that are connected to a drain electrode of the thin film transistor T1. In such a pixel structure, the gate lines G1~Gn are sequentially selected by the gate driver 140, and the gate-on voltage VON is applied to the selected gate line in the form of a pulse. As a result, the thin film transistor T1 of the pixel connected to the selected gate line is turned on. Then, a voltage including pixel information (hereinafter, referred to as a data voltage) is applied to each data line by the data driver 160. The data voltage passes through the thin film transistor T1 of the corresponding pixel and then is applied to the liquid crystal capacitor $C_{LC}$ and the storage capacitor $C_{ST}$. The liquid crystal capacitor $C_{LC}$ allows light to pass therethrough according to the data voltage applied to the liquid crystal capacitor $C_{LC}$ and the storage capacitor $C_{ST}$ when the thin film transistor T1 is turned on, and the storage capacitor $C_{st}$ stores the data voltage when the thin film transistor T1 is turned on. The charged data voltage is applied to the liquid crystal capacitor $C_{LC}$ when the thin film transistor T1 is turned off. Thus, images are displayed on the liquid crystal display 100.

Each pixel in the liquid crystal panel 130 includes three sub-pixels corresponding to red, green, and blue colors. The sub-pixels are sequentially disposed lengthwise along the gate line. In addition, the common electrode (not shown) is formed on the sub-pixels of the liquid crystal panel 130 such that the common voltage VCOM is applied to the common electrode.

The gate driver 140 scans the gate lines G1~Gn of the liquid crystal panel 130 in response to the control signals provided from the timing controller 110. Scanning refers to an operation of sequentially applying the gate-on voltage VON to the gate lines, so that each pixel connected to the gate line receiving the gate-on voltage VON can record data.

The gamma voltage generator 150 generates a preset positive gamma voltage and a preset negative gamma voltage upon receiving the analog supply voltage AVDD from the voltage converter 120. The positive gamma voltage and the negative gamma voltage have polarities opposite to each other relative to the common voltage VCOM.

Figure 2:
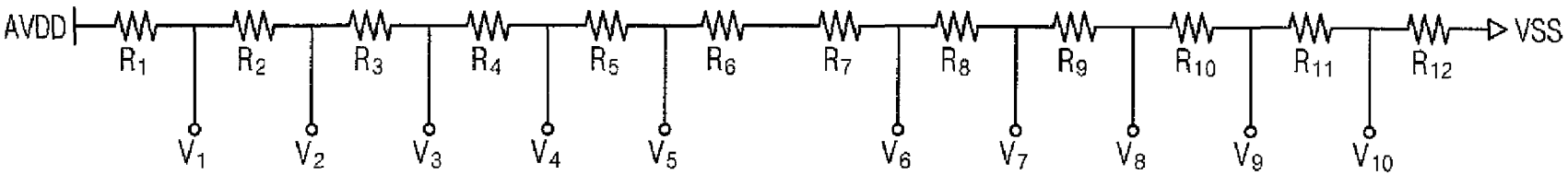
FIG. 2 is a circuit diagram showing a gamma voltage generator shown in FIG. 1.

As shown in FIG. 2, the gamma voltage generator 150 includes an array of resistors R1, R2, . . . , and R12 that are connected in series between the analog supply voltage AVDD and a ground voltage VSS. Node voltages, for example, V1, V2, . . . , and V10, formed among the resistors serve as the gamma voltages and are provided to the data driver 160. The number of resistors formed in the array may be changed, as desired to obtain finer or coarser gamma voltages.

The data driver 160 generates a plurality of gray scale voltages using the gamma voltages provided by the gamma voltage generator 150. The data driver 160 selects gray scale voltages corresponding to the pixel data signal RGB', in which the gray scale voltages are generated in response to the control signals provided from the timing controller 110 as described above, and applies the selected gray scale voltage to the data line of the liquid crystal panel 130.

In order to drive the liquid crystal display 100 having the above structure, the following operations are performed. First, the gate-on voltage VON is applied to the gate electrode of the thin film transistor T1 connected to the selected gate line, so that the thin film transistor T1 is turned on. The data voltage corresponding to the pixel data signal is applied to the source electrode of the thin film transistor T1, and then the data voltage is applied to the drain electrode. If the common voltage VCOM is applied to the common electrode of the liquid crystal panel 130, the liquid crystals are driven by a differential voltage between the common voltage VCOM and the data voltage. As a result, images are displayed on the liquid crystal display 100.

Figure 3:
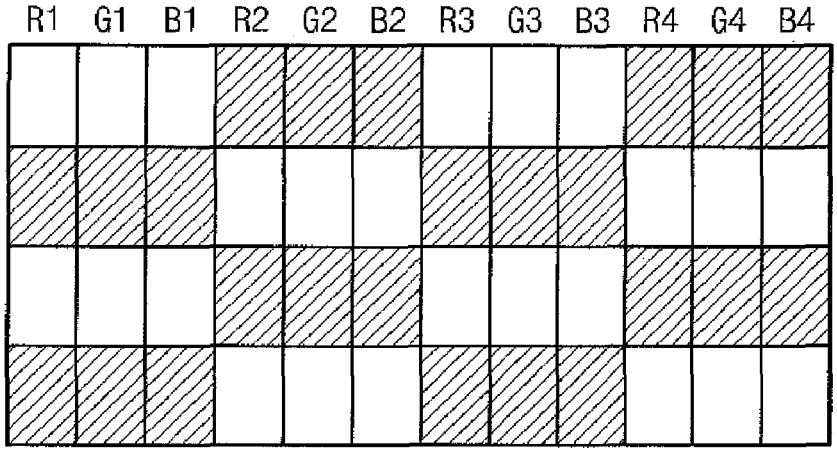
FIG. 3 is a view showing a pattern causing a greenish phenomenon in the liquid crystal display.
Figure 4:
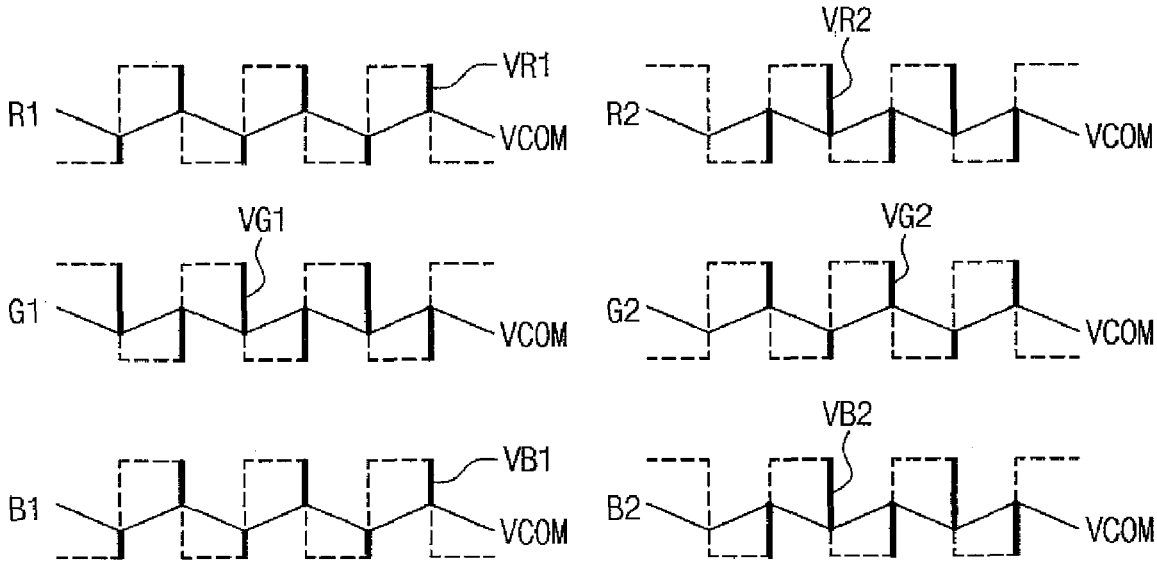
FIG. 4 is a view illustrating the greenish phenomenon derived from a swing of a common voltage caused by the pattern shown in FIG. 3.

FIG. 3 is a representation showing a pattern causing a greenish phenomenon in the liquid crystal display, and FIG. 4 is a diagram illustrating the greenish phenomenon derived from a swing of a common voltage caused by the pattern shown in FIG. 3.

As shown in FIG. 3, when a pattern, in which black gray-scale signals (corresponding to areas filled with hatching lines) and 31 gray-scale signals (corresponding to white areas) are alternated in a pixel unit, is displayed on the liquid crystal panel 130, data transitioned between adjacent pixels may not offset against each other. Accordingly, the common voltage VCOM and the gate-off voltage VOFF are swung by a parasitic capacitor. When a black pixel signal is provided to each of R1, G1, and B1 pixels, and a 31 gray-scale pixel signal is provided to each of R2, G2, and B2 pixels, the common voltage is swung according to the black pixel signal, so that, as shown in FIG. 4, pixel signal charge values VR1, VB1, and VG2 of the R1, B1, and G2 pixels are lower than pixel signal charge values VG1, VR2, and VB2 of the G1, R2, and B2 pixels. As a result, the R1, B1, G2 pixel may have a brightness higher than that of the remaining pixels. Because the R1 and B1 pixels receiving the black pixel signal are not visible to the naked eyes, however, a dot corresponding to the G2 pixel appears to be remarkably bright, resulting in a greenish phenomenon.

Figure 5:
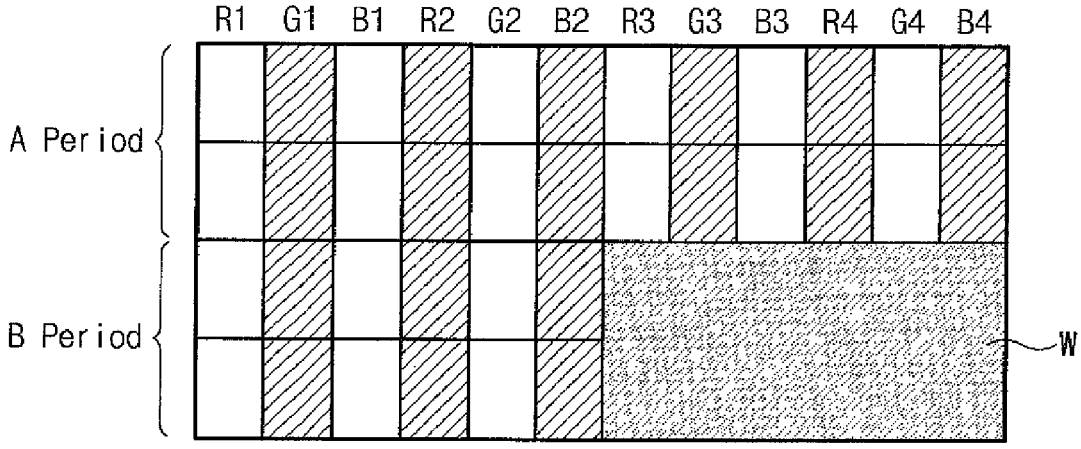
FIG. 5 is a view showing a pattern causing a horizontal crosstalk phenomenon in the liquid crystal display.
Figure 6:
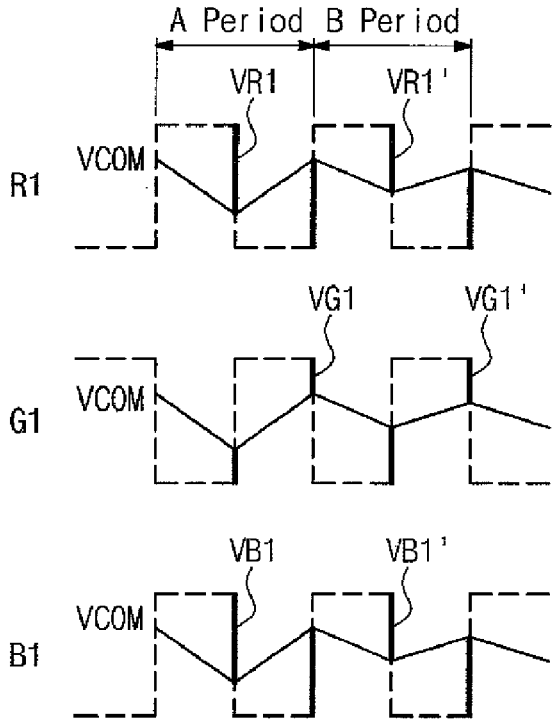
FIG. 6 is a view illustrating the horizontal crosstalk phenomenon derived from a swing of a common voltage in an 'A' period and a 'B' period shown FIG. 5.

FIG. 5 is a representation showing a pattern causing a horizontal crosstalk phenomenon in the liquid crystal display, and FIG. 6 is a diagram illustrating the horizontal crosstalk phenomenon derived from a swing of a common voltage in an 'A' period and a 'B' period shown FIG. 5.

As shown in FIG. 5, the liquid crystal panel 130 displays a pattern in which the 31-gray scale signals and the black gray scale signals are alternated in each sub-pixel. In addition, the liquid crystal panel 130 has a window area W to which gray scale signals having the same level are applied. Because the gray scale signals having the same level are applied to the window area W, the data transitioned between the adjacent pixels are offset against each other. Accordingly, as shown in FIG. 6, the common voltage VCOM and the gate-off voltage VOFF in the B period has a swing width smaller than that of the common voltage VCOM and the gate-off voltage VOFF in the A period that does not include the window area W. Accordingly, the pixels driven in the B period that includes the window area W has a charge value different from that of the pixels driven in the A period that does not include the window area W.

More specifically, in the case of the R1, G1, and B1 lines shown in FIG. 6, the R1 and B1 lines except for the G1 line, which is not visible to the naked eye, provided with the black pixel signal have charge values VR1' and VB1' in the B period, which are smaller than charge values VR1 and VB1 in the A period, respectively. As a result, the pixels driven in the B period including the window area W have a brightness higher than that of the pixels driven in the A period that does not include the window area W, resulting in the horizontal crosstalk.

In order to prevent the greenish phenomenon and the horizontal crosstalk that are described in FIGS. 3 to 6, the gamma voltage compensator 170 is further provided.

Referring again to FIG. 1, the gamma voltage compensator 170 compensates for at least one of the gamma voltages provided from the gamma voltage generator 150 by using the gate-off voltage VOFF output from the voltage converter 120.

Figure 7:
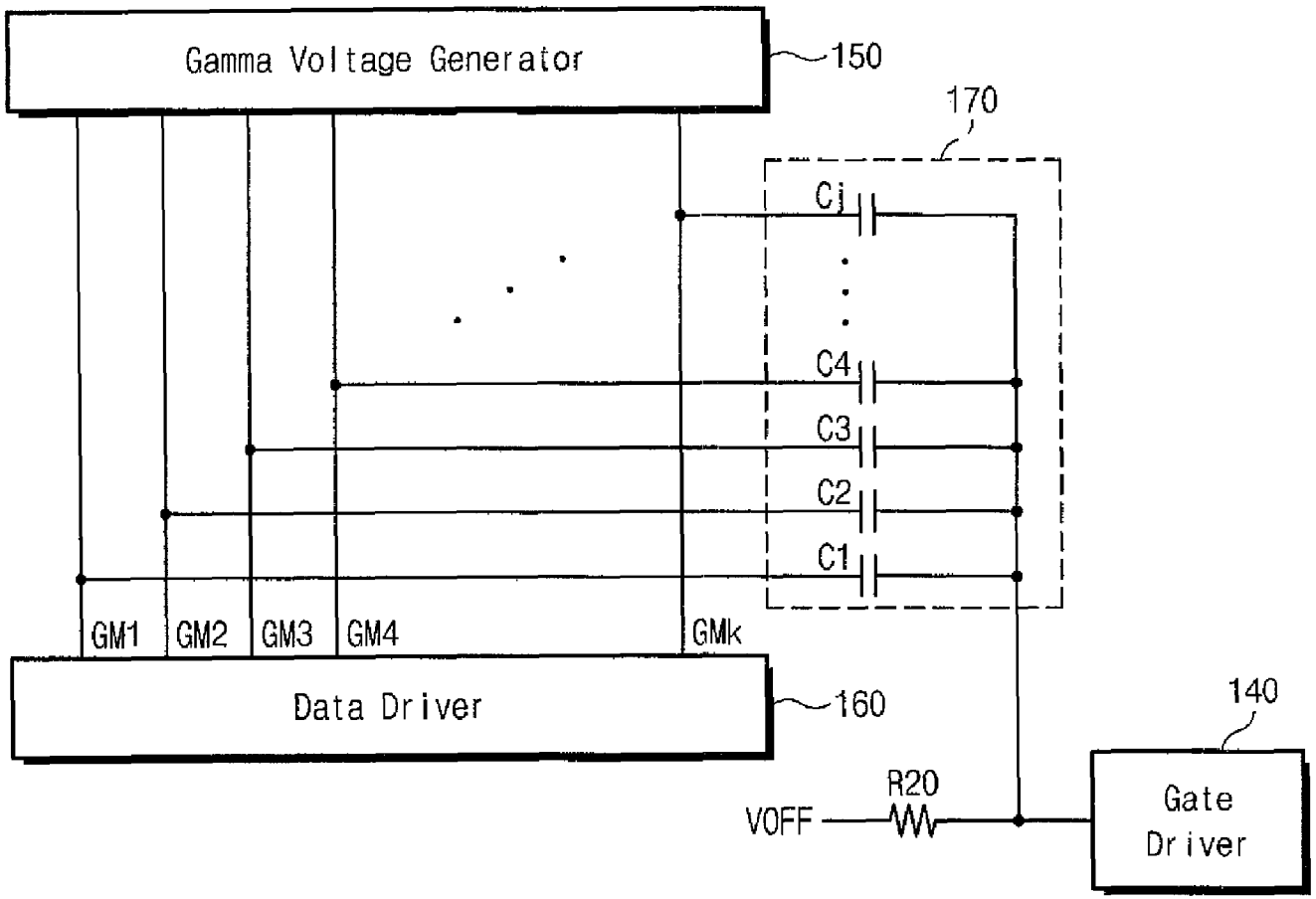
FIG. 7 is a view showing a gamma voltage compensator shown in FIG. 1.

FIG. 7 is a view showing a gamma voltage compensator 170 shown in FIG. 1.

The gamma voltage compensator 170 includes j capacitors C1, C2, . . . , and Cj that are connected to k gamma voltage output lines GM1 to GMk, respectively, in which j is an integer from one to k. The capacitors may have capacitances different from each other. Alternatively, at least two of the capacitors may have the same capacitance.

Meanwhile, if the gate-off voltage VOFF has a small swing width, a resistor R20 having a resistance, for instance, within a range of 0Ω to 300Ω, is connected in series with a gate-off voltage output line connected between the voltage converter 120 and the gate driver 140. The gate-off voltage passing through the resistor R20 is provided to the gamma voltage compensator 170.

When many data transitions occur, the gate-off voltage VOFF is swung by a capacitive coupling between the source electrode and the gate electrode of the thin film transistor T1 of each pixel, as shown in FIG. 1. At least one of the capacitors in the gamma voltage compensator 170 causes a capacitive coupling between the gate-off voltage VOFF and the at least one gamma voltage. Accordingly, the at least one gamma voltage is swung to have the same phase as the gate-off voltage VOFF, and the data voltage is compensated according to the swung gamma voltage.

Figure 8:
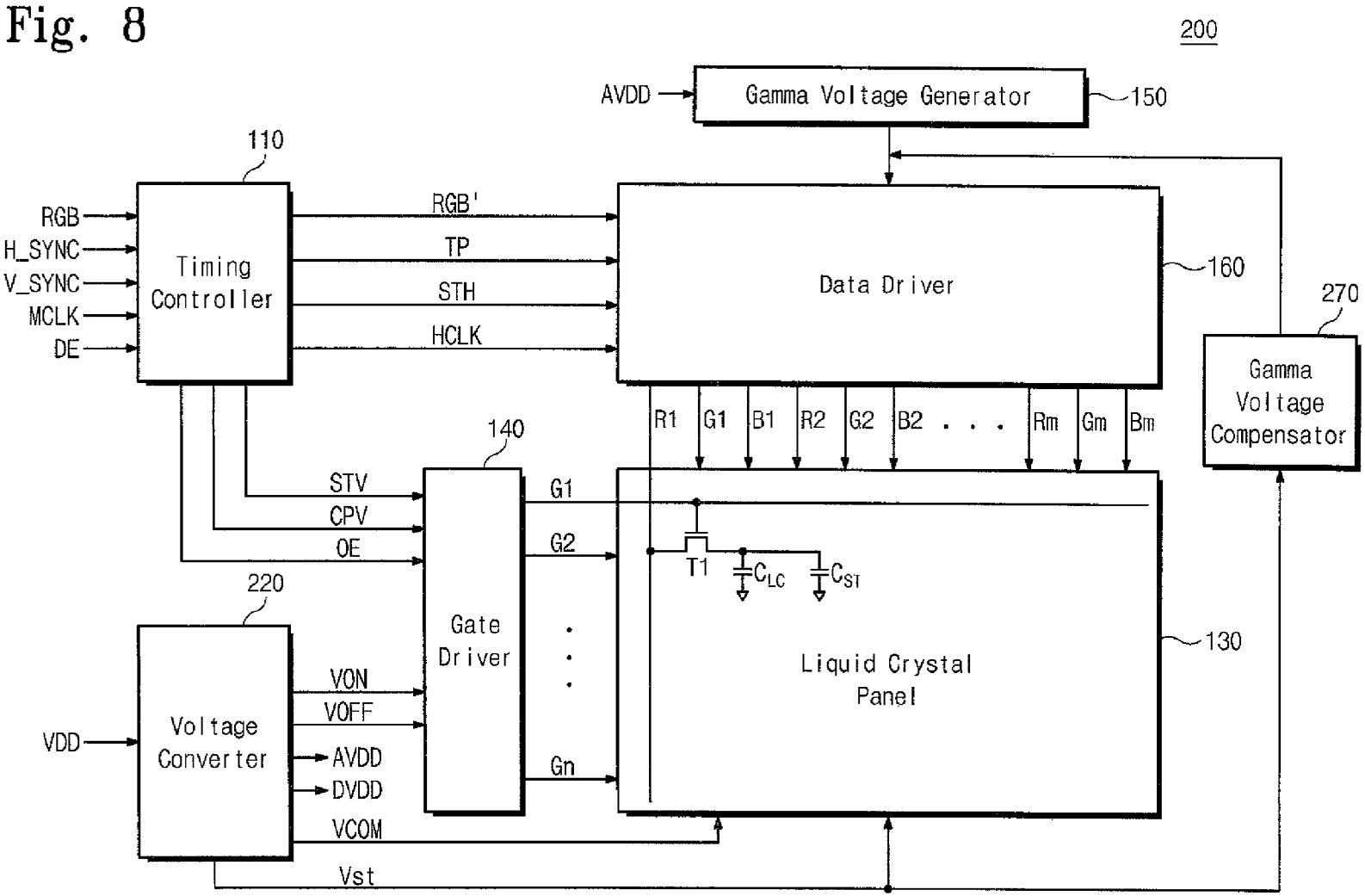
FIG. 8 is a block diagram showing an exemplary embodiment of a liquid crystal display according to the present invention.
Figure 9:
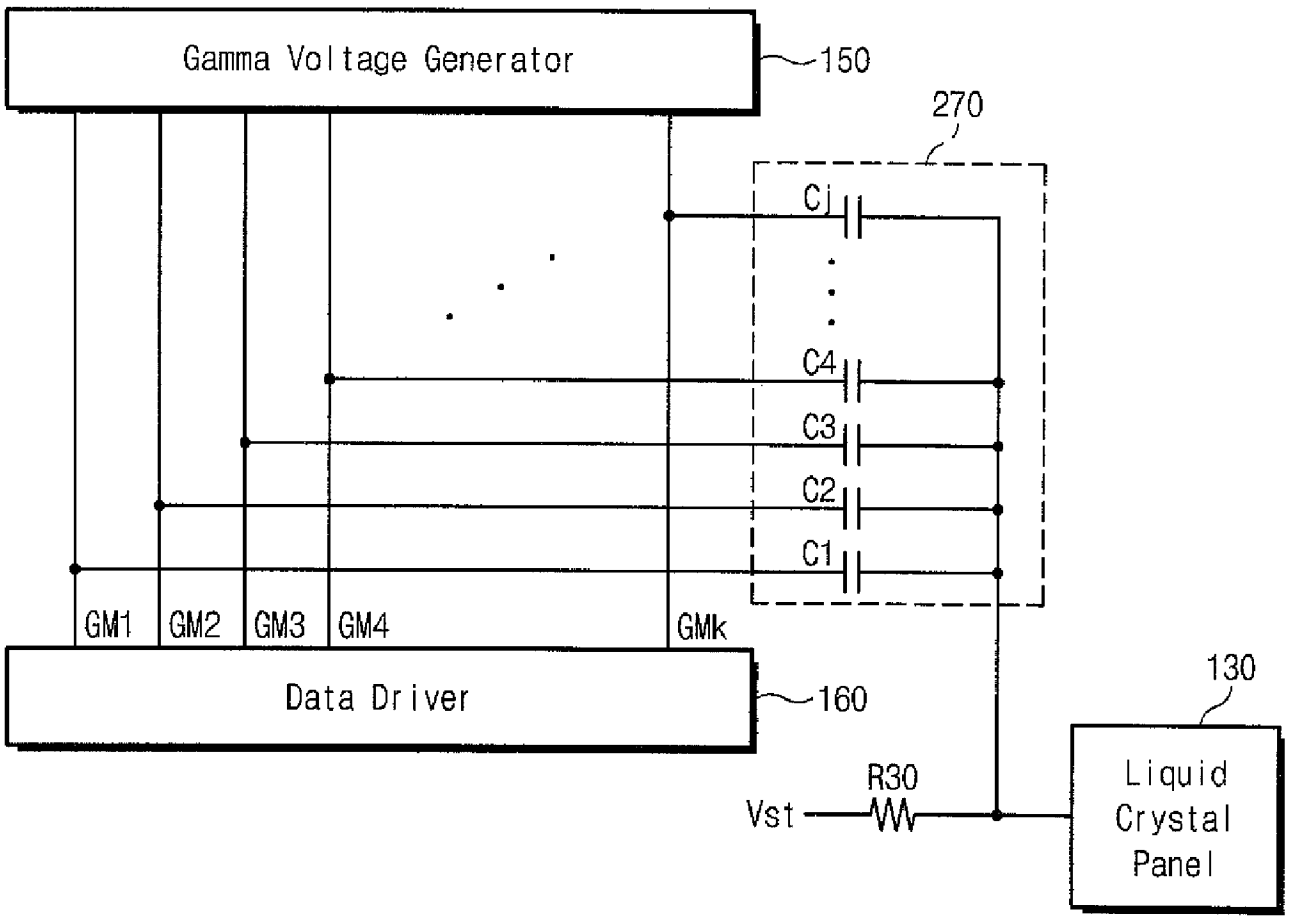
FIG. 9 is a view showing a gamma voltage compensator shown in FIG. 8.

FIG. 8 is a block diagram showing an exemplary embodiment of a liquid crystal display according to the present invention, and FIG. 9 is a view showing in detail a gamma voltage compensator shown in FIG. 8.

In FIGS. 8 and 9, the timing controller 110, the liquid crystal panel 130, the gate driver 140, the gamma voltage generator 150 and the data driver 160 have a structure substantially identical to those of the exemplary embodiment shown in FIGS. 1 and 7. For convenience sake, the same reference numerals will be assigned to blocks having the same function as those of the above-described exemplary embodiment, and a further description of the blocks will be omitted in order to avoid redundancy.

Referring to FIG. 8, a voltage converter 220 receives the DC power VDD from the outside to generate a plurality of voltages used to operate the liquid crystal display 200. The voltages used to operate the liquid crystal display 200 include an analog supply voltage AVDD, a digital supply voltage DVDD, a gate-on voltage VON, a gate-off voltage VOFF, a common voltage VCOM and a voltage applied to the storage capacitor $C_{ST}$, hereinafter referred to as a storage voltage Vst. The storage voltage Vst may be the common voltage VCOM, the ground voltage, or a voltage independent of the common voltage VCOM. In the present exemplary embodiment, the voltage Vst independent of the common voltage VCOM is applied to the storage capacitor Cst.

In the exemplary embodiments shown in FIGS. 1 and 7, the gamma voltage compensator 170 compensates for at least one gamma voltage by using the gate-off voltage VOFF. On the other hand, as shown in FIGS. 8 and 9, a gamma voltage compensator 270 compensates for at least one gamma voltage generated from a gamma voltage generator 250 by using the storage voltage Vst. If the storage voltage Vst has a small swing width, a resistor R30 shown in FIG. 9 having a resistance, for example, within a range of 0Ω to 300Ω, is connected in series with a storage voltage output line between the voltage converter 220 and the liquid crystal panel 130. The storage voltage Vst after passing through the resistor R30 is provided to the gamma voltage compensator 270.

When many data transitions occur, similar to the gate-off voltage VOFF, the storage voltage Vst is swung by a capacitive coupling between the source electrode and the gate electrode of the thin film transistor T1. At least one of capacitors C1 to Cj in the gamma voltage compensator 270 causes a capacitive coupling between the storage voltage Vst and at least one of the gamma voltages. Accordingly, the at least one gamma voltage is swung to have the same phase as that of the storage voltage Vst, and the data voltage is compensated according to the swung gamma voltage.

Figure 10:
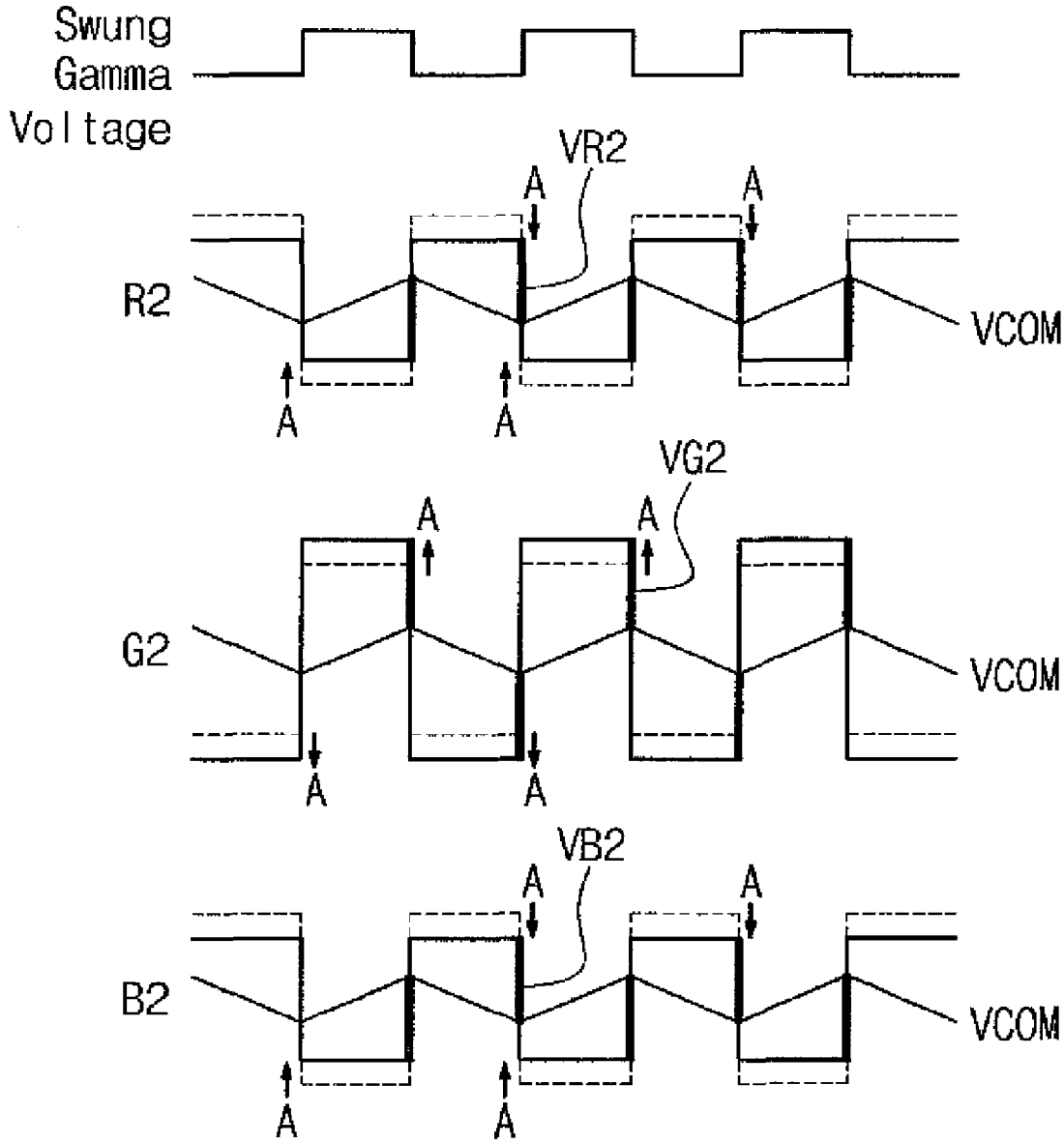
FIG. 10 is a view illustrating compensation of a pixel data voltage when the pattern shown in FIG. 3 is displayed on a liquid crystal panel.

FIG. 10 is a waveform diagram illustrating compensation of a pixel data voltage when the pattern shown in FIG. 3 is displayed on a liquid crystal panel.

As shown in FIG. 10, the pixel data voltage is compensated by the gamma voltages swung by the gamma voltage compensator 170 or 270, so that the pixels have the same pixel signal charge value. For example, the pixel signal charge values VR2, VG2 and VB2 of the R2, G2 and B2 pixels are identical to each other. Accordingly, even if the pattern shown in FIG. 3 is displayed on the liquid crystal panel 130, the greenish phenomenon causing the G2 pixel to have brightness higher than that of the remaining pixels can be prevented.

Figure 11:
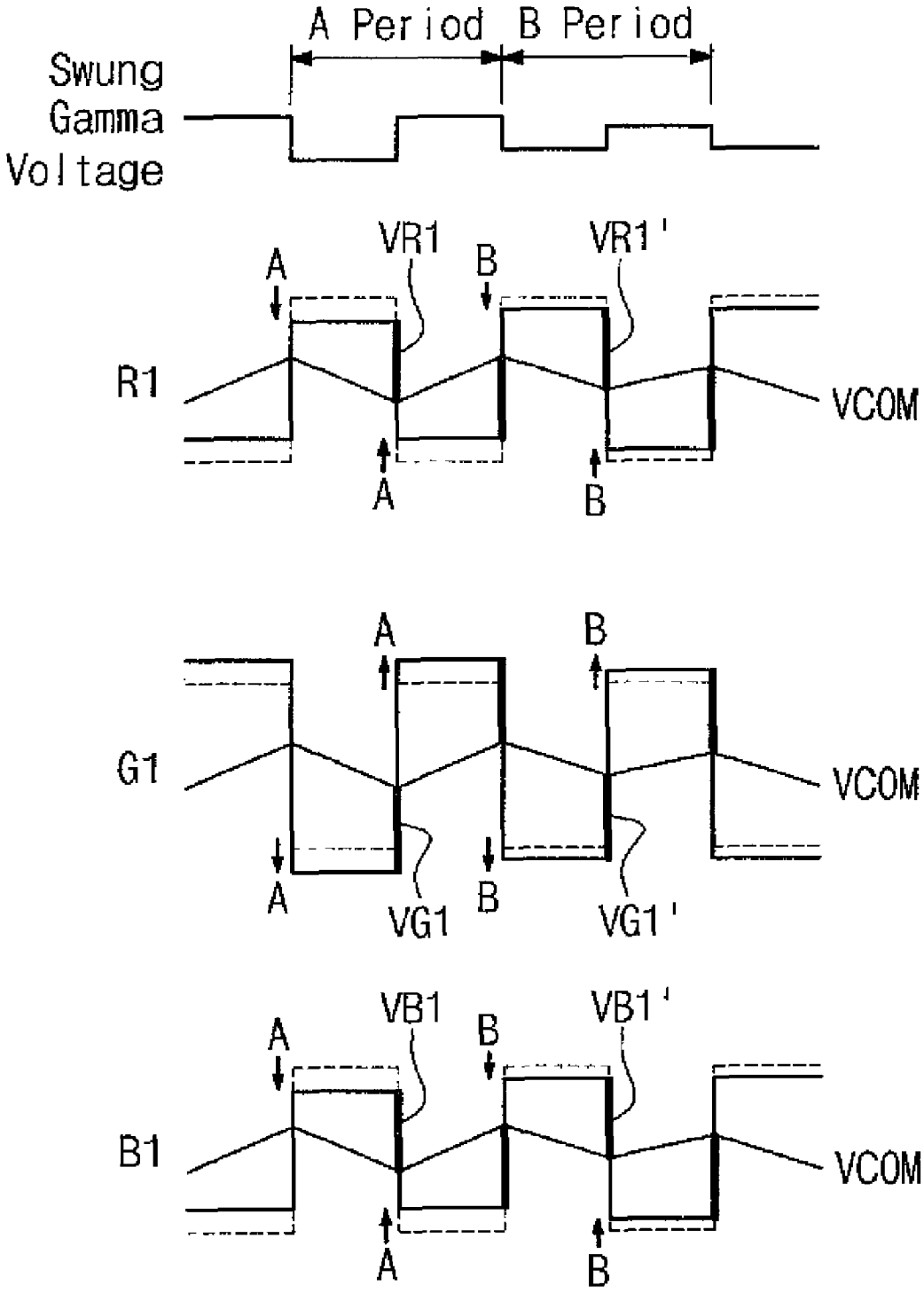
FIG. 11 is a view illustrating compensation of a pixel data voltage when the pattern shown in FIG. 4 is displayed on a liquid crystal panel.

FIG. 11 is a waveform diagram illustrating compensation of a pixel data voltage when the pattern shown in FIG. 4 is displayed on a liquid crystal panel.

As shown in FIG. 11, in the case of the R1, G1 and B1 lines shown in FIG. 11, the R1 and B1 lines, except for the G1 line (not visible to the naked eye) provided with the black pixel signal have charge values VR1' and VB1' in the B period, which are equal to charge values VR1 and VB1 in the A period, respectively. As a result, the horizontal crosstalk causing the pixels driven in the B period including the window area W shown in FIG. 5 to have a brightness higher than that of the pixels driven in the A period, which does not include the window area W, is prevented.

Figure 12:
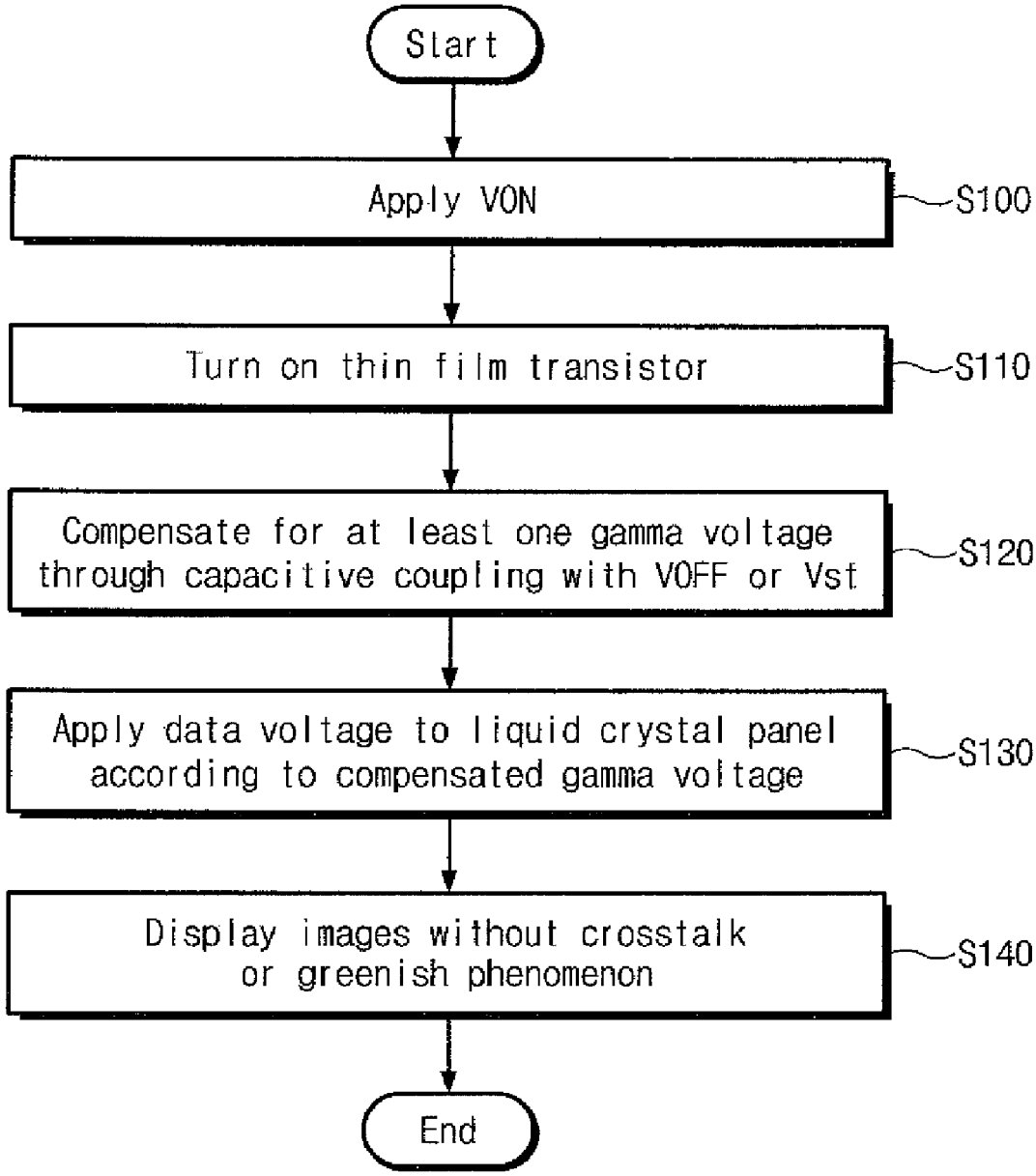
FIG. 12 is a flowchart illustrating an exemplary embodiment of a method of operating a liquid crystal display according to the present invention.

FIG. 12 is a flowchart illustrating an exemplary embodiment of a method of operating a liquid crystal display according to the present invention.

Referring to FIG. 12, the gate driver 140 applies the gate-on voltage VON to the gate electrode of the thin film transistor connected to a predetermined gate line such that the thin film transistor is turned on (S100 and S110). The gamma voltage compensator 170 or 270 compensates for at least one of the gamma voltages generated from the gamma voltage generator 150 through a capacitive coupling between the at least one gamma voltage and one of the gate-off voltage VOFF and the storage voltage Vst (S120). The data driver 160 applies the data voltage corresponding to the pixel data signal to the liquid crystal panel 130 according to the at least one gamma voltage compensated through the capacitive coupling (S130). As a result, the crosstalk or the greenish phenomenon does not occur in the images.

Although exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. A liquid crystal display comprising:

a liquid crystal panel having a plurality of pixels respectively arranged in pixel areas;

a gate driver that receives a gate-on voltage and a gate-off voltage to sequentially apply the gate-on voltage to the gate lines;

a gamma voltage generator that generates a plurality of gamma voltages having voltage levels different from each other;

a data driver that generates data voltages based on the plurality of gamma voltages and provides the data voltages to the data lines, respectively; and a gamma voltage compensator that compensates for at least one of the plurality of gamma voltages, which are generated by the gamma voltage generator, by using the gate-off voltage, wherein the gamma voltage compensator comprises at least one capacitor that capacitively couples the gate-off voltage with at least one of the plurality of gamma voltages.

2. The liquid crystal display of claim 1, wherein the gamma voltage generator comprises a plurality of gamma voltage output lines to output respectively the plurality of gamma voltages, and wherein the at least one capacitor is connected between a terminal to which the gate-off voltage is applied and at least one of the plurality of gamma voltage output lines.

3. The liquid crystal display of claim 2, wherein the gamma voltage compensator further comprises a resistor connected between the at least one capacitor and the terminal to which the gate-off voltage is applied.

4. A liquid crystal display comprising:

a liquid crystal panel having a plurality of pixels respectively arranged in pixel areas, in which each pixel includes a liquid crystal capacitor and a storage capacitor in parallel to the liquid crystal capacitor;

a gate driver that receives a gate-on voltage and a gate-off voltage to sequentially apply the gate-on voltage to the gate lines;

a gamma voltage generator that generates a plurality of gamma voltages having voltage levels different from each other;

a data driver that generates data voltages based on the plurality of gamma voltages and provides the data voltages to the data lines, respectively; and a gamma voltage compensator that compensates for at least one of the plurality of gamma voltages, which are generated the gamma voltage generator, by using a storage voltage applied to the storage capacitor wherein the gamma voltage compensator comprises at least one capacitor that capacitively couples the storage voltage with at least one of the plurality of gamma voltages.

5. The liquid crystal display of claim 4, wherein the gamma voltage generator comprises a plurality of gamma voltage output lines to output respectively the plurality of gamma voltages, and wherein the at least one capacitor is connected between a terminal to which the storage voltage is applied and at least one of the plurality of gamma voltage output lines.

6. The liquid crystal display of claim 5, wherein the gamma voltage compensator further comprises a resistor connected between the at least one capacitor and the terminal to which the storage voltage is applied.

7. A method of operating a liquid crystal display, the method comprising:

sequentially outputting a gate-on voltage to a liquid crystal panel being driven based on the gate-on voltage and a gate-off voltage;

generating a plurality of gamma voltages having voltage levels different from each other;

generating data voltages based on the plurality of gamma voltages and providing the data voltages to the liquid crystal panel; and compensating for at least one of the plurality of gamma voltages by using the gate-off voltage, wherein the at least one gamma voltage is compensated through capacitive coupling between the gate-off voltage and the at least one gamma voltage.

8. The method of claim 7, further comprising providing the plurality of gamma voltages to a plurality of gamma voltage output lines and providing the capacitive coupling between a terminal to which the gate-off voltage is applied and at least one of the plurality of gamma voltage output lines.

9. The method of claim 8, wherein the capacitive coupling is provided by at least one capacitor.

10. The method of claim 9, further comprising connecting a resistor between the at least one capacitor and the terminal.

11. A method of operating a liquid crystal display, the method comprising:

sequentially outputting a gate-on voltage to gate lines of a liquid crystal panel being driven based on the gate-on voltage and a gate-off voltage;

generating a plurality of gamma voltages having voltage levels different from each other;

generating data voltages based on the plurality of gamma voltages and providing the data voltages to the liquid crystal panel;

generating a storage voltage to provide the storage voltage to a storage capacitor of the liquid crystal panel; and compensating for at least one of the plurality of gamma voltages by using the storage voltage wherein the at least one gamma voltage is compensated through a capacitive coupling between the storage voltage and the at least one gamma voltage.

12. The method of claim 11, further comprising providing the plurality of gamma voltages to a plurality of gamma voltage output lines and providing the capacitive coupling between a terminal to which the storage voltage is applied and at least one of the plurality of gamma voltage output lines.

13. The method of claim 12, wherein the capacitive coupling is provided by at least one capacitor.

14. The method of claim 13, further comprising connecting a resistor between the at least one capacitor and the terminal.

* * * * *